US011725356B2

(12) United States Patent
Brakman et al.

(10) Patent No.: US 11,725,356 B2
(45) Date of Patent: Aug. 15, 2023

(54) PILE INSTALLATION SYSTEM

(71) Applicant: Fundex Equipment B.V., Middelburg (NL)

(72) Inventors: Johannes Pieter Brakman, Schoondijke (NL); Anthonie Leenard Rottier, Schoondijke (NL); Antonius Maria Hectors, Schoondijke (NL)

(73) Assignee: Fundex Equipment B.V., Middelburg (NL)

( * ) Notice: Subject to any disclaimer, the term of this patent is extended or adjusted under 35 U.S.C. 154(b) by 62 days.

(21) Appl. No.: 17/262,234

(22) PCT Filed: Jul. 23, 2019

(86) PCT No.: PCT/NL2019/050469
§ 371 (c)(1),
(2) Date: Jan. 22, 2021

(87) PCT Pub. No.: WO2020/022882
PCT Pub. Date: Jan. 30, 2020

(65) Prior Publication Data

US 2021/0301490 A1 Sep. 30, 2021

(30) Foreign Application Priority Data

Jul. 23, 2018 (NL) ..... 2021375

(51) Int. Cl.

| | |
|---|---|
| ***E02D 5/44*** | (2006.01) |
| ***E02D 3/054*** | (2006.01) |
| ***E02D 5/38*** | (2006.01) |
| *E02D 5/72* | (2006.01) |

(52) U.S. Cl.
CPC ..... *E02D 5/44* (2013.01); *E02D 3/054* (2013.01); *E02D 5/385* (2013.01); *E02D 5/72* (2013.01)

(58) Field of Classification Search
CPC combination set(s) only.
See application file for complete search history.

(56) References Cited

U.S. PATENT DOCUMENTS 4,496,922 A * 1/1985 Pardee ..... H01F 7/08 188/164
6,413,019 B1 * 7/2002 Coombs ..... E21D 20/006 173/39

FOREIGN PATENT DOCUMENTS

| | | | |
|---|---|---|---|
| CH | 490 578 | A | 5/1970 |
| DE | 94 04 506 | U1 | 6/1994 |
| DE | 196 11 638 | A1 | 10/1997 |
| DE | 10 2006 023799 | A1 | 11/2007 |
| EP | 1134319 | A1 | 9/2001 |
| JP | S56 82044 | U | 7/1981 |
| JP | 3049645 | U | 6/1998 |
| KR | 20120139895 | A * | 12/2012 |

* cited by examiner

*Primary Examiner* — Kyle Armstrong
(74) *Attorney, Agent, or Firm* — N.V. Nederlandsch Octrooibureau

(57) ABSTRACT

The invention relates to a pile installation system for providing a pile in the ground, comprising;
- an elongate pile installation tool for forming a bore hole and having a distal end,
- an end member for coupling to the distal end of the pile installation tool, and
- an electromagnetic device for releasable magnetically coupling the end member to the pile installation tool.

23 Claims, 7 Drawing Sheets

PILE INSTALLATION SYSTEM

FIELD OF THE INVENTION

The present invention relates to a pile installation system for providing a pile in the ground, in particular a foundation pile. The invention further relates to a method for providing a pile in the ground using a pile installation system.

BACKGROUND ART

A pile or piling is a vertical structural element that can be used for deep foundation. Such a pile may be driven, vibrated, pushed or drilled deep into the ground at the building site or formed in situ. Foundation piles for deep foundation is a type of foundation that is able to transfer loads of building structures to an earth layer further down from the ground surface. Therefore these foundation piles may have lengths of several tens of meters. There are a number of reasons that a geotechnical engineer would recommend a deep foundation over a shallow foundation. Usual reasons are very large design loads, a poor soil at shallow depth.

An example of a pile that is formed in situ is an auger cast pile, often known as a continuous flight augering (CFA) pile. The pile is formed by drilling into the ground with a hollow stemmed continuous flight auger to the required depth or degree of resistance. No casing is required, however a casing may be used in addition. A cement grout mix is then pumped down the stem of the auger. While the cement grout is pumped, the auger is slowly withdrawn, conveying the soil upward along the flights. A shaft of fluid cement grout is formed to ground level. Reinforcement is usually installed. Auger cast piles cause minimal disturbance, and are often used for noise and environmentally sensitive sites.

Such a pile installation system is known from JP3049645U. In this publication, a plurality of permanent magnets is embedded in the end of a pile installation tool. The magnetic force of the magnetic field attaches an end plate to the distal end portion of the pile installation tool.

The known pile installation system needs improvement for safety and efficiency reasons. It is highly undesirable to manually manoeuvre a pile bottom plate (e.g. drill tip) below a heavy pile installation tool by personnel. The solution proposed in JP3049645 has for its object to solve the problem however introduces other disadvantages. In case of vibration or piling, the shocks can cause demagnetisation of the permanent magnets. The permanent magnetism will cause continuous attraction of steel parts which is very troublesome. In particular, in case of wrong positioning of the bottom plate, repositioning is difficult. Moreover, it is difficult to guarantee that the bottom plate will be released from the tool at the desired moment/depth. In addition, the pile installation tool needs to be modified to integrate the permanent magnets. Lastly, the permanent magnets can be mechanically damaged while drilling/vibrating/piling in the ground.

SUMMARY OF THE INVENTION

The present invention seeks to provide a pile installation system wherein handling of an end member is more controllable including more safe.

The present invention seeks to provide a pile installation system wherein a problem associated with known pile installation systems is at least partly solved.

The present invention seeks to provide a pile installation system with an alternative way to connect the end member to the pile installation tool.

Therefore, the invention provides a pile installation system for providing a pile in the ground, comprising;

- an elongate pile installation tool for forming a bore hole and having a distal end,
- an end member for coupling to the distal end of the pile installation tool,
- an electromagnetic device for releasable magnetically coupling the end member to the pile installation tool.

The electromagnetic system provides a controllable magnetic attraction force between the pile installation tool and the end member. As long as the electromagnetic system is energized, the end member will stick to the tool. The tool can move freely in axial direction in relation to the electromagnetic system. The electromagnetic system will be activated when needed. Therefore, undesired attraction of the bottom plate and other steel parts is avoided as much as possible. This way it is possible to position the end member below the tool from the side without hinder of any magnetic attraction force. The invention solves the problem of dangerous and not ergonomic manual way of supporting the end member during the vertical movement of the pile installation tool to the ground. So at least during that period of vertical movement, the electromagnetic device is activated. Therefore, it is no longer needed to support the end member during the vertical movement of the pile installation tool to the ground, and safety and ergonomics is increased. Next to that it has time saving potential. From the moment the end member is in the soil for some distance (0-500 mm), the magnet may be deactivated, since the soil resistance can make sure the end member stays connected to the pile installation tool.

The electromagnetic device enables to automate the process of connecting the end member to the pile installation tool. Therefore, the pile installation system of the invention is also very suitable to work in conjunction with positioning systems, e.g. by means of GNSS, on the foundation machine, since in that case there are no stakes to point out where to put the end members.

The elongate pile installation tool may form the bore hole or at least assist in forming the bore hole. It will be clear that the bore hole is an in between step to reach the end result of a foundation pile. The pile installation tool can thus be any tool that contributes to the formation of a foundation pile, like for example a hollow or solid pile, a casing, an auger. The shape of the tool is generally cylindrical, however other shapes may be conceivable.

The end member may serve different purposes like closing off an open end of a tool, and assisting in forming the bore hole. In the foundation pile installation field, the end member is also referred to as pile bottom plate, lost shoe, end plate, or forming tip.

In an embodiment of the pile installation system, the electromagnetic device is configured to be remoteably operateable to be activated and/or deactivated. This even more enables operators to avoid undesired attraction of the bottom plate and other steel parts. I will be clear that remoteably operateable may include a wired or wireless connection. Remote has to be understood as remote enough from the pile installation tool to ensure safety for an operator while the operator can preferably still observe the coupling between the end member and the pile installation tool.

In an embodiment of the pile installation system, an outer diameter of the end member is about an outer diameter of the pile installation tool. This enables to close off an open end of the tool entirely and enables to mount cutting tools on the end member that extend at the outer circumference of the tool. This also enables the use of the pile installation tool in combination with a vibrator, a piling hammer or with a pressing device, making its functionality more versatile.

In an embodiment, the pile installation system comprises a filling system for introducing filling material, like concrete, into the bore hole after the pile installation tool has been driven into the ground. The pile installation system comprising filling system enables to reduce the need of an operator in the entire foundation pile installation process.

In an embodiment of the pile installation system, the distal end of the pile installation tool is open and in fluid communication with the filling system and the end member is configured to close at least partially the open end. The distal end of the tool being open enables to fill the formed bore hole with the filling material in a controlled manner by deactivating the electromagnetic device and thus releasing the end member from the tool and opening the distal end of the tool. It will be clear that the electromagnetic device can be deactivated when desired, as soon as the end member is on or a bit in the soil. In that case, the soil will press the end member onto the pile installation tool while the pile installation tool advances into the ground.

The pile installation tool being open and in fluid communication with the filling system, means that the bore hole can be filled through the pile installation tool.

In an embodiment, the pile installation system comprises a drive apparatus to drive the pile installation tool into the ground.

In an embodiment of the pile installation system, the pile installation tool is a rotary drilling tool having an axis of rotation, and the drive apparatus comprises a rotary drive to drive the rotary drilling tool into the ground. Use of a rotary drilling tool is possible since the pile installation tool is freely rotatable around its longitudinal axis with respect to the electromagnetic device In an embodiment of the pile installation system, the pile installation tool comprises a hollow tubular element and the drive apparatus comprises a hydraulic hammer and/or a vibration hammer to drive the hollow tubular element into the ground. The hollow tubular element is for example a hollow pile.

In an embodiment of the pile installation system, the rotary drilling tool is a rotatable auger having an external blade or blades so shaped that upon rotation the blade or blades draws or draw the auger into the ground. By having the external blade or blades, it is possible to minimize friction between the pile installation tool and surrounding soil during inserting of the pile installation tool into the ground.

In an embodiment of the pile installation system, the end member is configured such that loosened soil is directed towards the axis of rotation upon driving the drilling tool.

In an embodiment of the pile installation system, the end member comprises a cutting element at a leading side of the end member. The end member comprising a cutting element at a leading side of the end member facilitates forming of the bore hole.

The cutting element arranged at a leading side of the end member includes a cutting element on the front face and/or circumference of the end member. It will be clear that although an end member having a cutting element is useful, an end member without a cutting element is still conceivable.

In an embodiment of the pile installation system, the cutting element extends beyond an outer circumference of the end member. The cutting element extending beyond an outer circumference of the end member facilitates forming of the bore hole even more. In addition, the friction between the tool and surrounding soil during inserting the into the ground is minimized since the preformed opening/hole will have a slightly wider diameter than the tool itself or at least will softened the soil before the tool does it. I will be clear that the end member is not restricted to this form having a cutting element that extends beyond an outer circumference of the end member.

In an embodiment of the pile installation system, the electromagnetic device comprises an annular coil that extends around the pile installation tool. This facilitates an optimal magnetic coupling between the electromagnetic device and the pile installation tool and therefore an optimal magnetic coupling between the pile installation tool and the end member. Also, the annular coil and the pile installation tool can be maintained aligned easily. It will clear that the magnetic coupling between the electromagnetic device and the pile installation tool can be realised in a different way like e.g. by using a side coil next to the pile installation tool that does not extend around the pile installation tool, or a divisible annular coil.

In an embodiment of the pile installation system, the rotary drive apparatus comprises a rotor coupled with the pile installation tool and a stator coupled with the electromagnetic device, wherein the pile installation tool is slideably arranged with respect to the electromagnetic device to slide through the annular coil, in particular through a centre of the annular coil. This even more facilitates an optimal magnetic coupling between the electromagnetic device and the pile installation tool in different height positions of the pile installation tool with respect to the magnetic system.

The pile installation tool being slideably arranged with respect to the electromagnetic device includes a sliding contact between the pile installation tool and the magnetic system. It is however conceivable that the pile installation tool moves without contacting the electromagnetic device In an embodiment, the pile installation system comprises alignment means to align the end member with respect to the open distal end of the pile installation tool. The alignment means assure a controlled position of the end member with respect to the pile installation tool.

The aligned position may include a centrally aligned end member with respect to the pile installation tool. The alignment means may also constrain the end member in circumferential direction to support cutting action through the end member.

In an embodiment of the pile installation system, the pile installation tool and the end member are at least partially made of a magnetisable material like steel in order to, in conjunction, form a magnetic circuit.

In an embodiment of the pile installation system, the electromagnetic device comprises a control unit to adjust a magnetic force between the pile installation tool and the end member. This facilitates even more control of the magnetic attraction force between the pile installation tool and the end member.

In an embodiment, the pile installation system comprises an end member feeding system for supplying the end member to the pile installation tool. The end member feeding system even more increases safety and ergonomics. Any suitable end member feeding system is conceivable like e.g. based on a pick and place principle or a belt system. The end member feeding system functions to automatically arrange an end member into a position wherein the end member contacts the distal end of the pile installation tool.

In an embodiment of the pile installation system, the end member feeding system is coupled to the pile installation tool and arranged radially offset with respect to the longitudinal axis of the pile installation tool. This arrangement assures that the end member feeding system does not interfere with the pile installation process.

In an embodiment of the pile installation system, the end member feeding system is swivelably coupled to the pile installation tool. This even more enables to avoid that the end member feeding system can interfere with the pile installation process. In particular, the end member feeding system is swivelably around a swivel axis parallel with respect to the longitudinal axis of the pile installation tool, however a different orientation of the swivel axis is conceivable.

In an embodiment of the pile installation system, the end member feeding system comprises a storage for storing a number of end members as well as a handling system for moving an end member from the storage to the pile installation tool.

In an embodiment of the pile installation system, the storage extends in parallel to the pile installation tool. The storage extending in parallel to the pile installation tool enables to minimize the footprint of the end member feeding system.

In an embodiment of the pile installation system, the handling system comprises a first handling unit for moving an end member in a radial direction with respect to the pile installation tool. The handling system comprising a first handling unit for moving an end member in a radial direction with respect to the pile installation tool even more enables that the end member feeding system does not interfere with the pile installation process.

In an embodiment of the pile installation system, the handling system comprises a second handling unit for moving an end member in an axial direction with respect to the pile installation tool. The handling system comprising a second handling unit for moving an end member in an axial direction with respect to the pile installation tool enables to position the end member within reach of the electromagnetic device for magnetically coupling the end member to the pile installation tool. Although the handling systems as now defined has a first and second handling unit, in reality system boundaries may be not so strict and can be "fluid". For example, one of the first and second handling unit may be configured to move an end member in both an axial direction and radial direction with respect to the pile installation tool.

In an embodiment of the pile installation system, the first and second handling unit are series coupled. The series coupling concerns the mechanical series coupling between the first and second handling unit that will define the movement sequence of the end member from the storage towards the pile installation tool.

In an embodiment of the pile installation system, the handling system, in particular the second handling unit thereof, comprises a parallel guide system. The handling system comprising a parallel guide system enables to move the end member towards the pile installation while maintaining a defined orientation of the end member in which defined orientation the end member can contact the pile installation tool.

In an embodiment, the pile installation system comprises a cleaning system for cleaning the distal end of the pile installation tool before coupling the end member to the pile installation tool. The cleaning of the distal end of the pile installation tool before coupling the end member to the pile installation tool, improves contact and/or contact area between the distal end of the pile installation tool and the end member which in turn improves the magnetic coupling and the contact force between the distal end of the pile installation tool and the end member.

In an embodiment of the pile installation system, the cleaning system comprises a fluid jetting system. The fluid is most likely water, however other suitable fluids are conceivable like e.g. sand in a sand blasting process.

Therefore, the invention provides a method for providing a pile in the ground using a pile installation system comprising;

a pile installation tool having a distal end, an end member for coupling to the distal end of the pile installation tool, the method comprising;

activating an electromagnetic device for magnetically coupling the end member to the distal end of the pile installation tool before introducing the pile installation tool into the ground.

The electromagnetic device can be activated when required. Therefore, undesired attraction of the bottom plate and other steel parts is avoided as much as possible. This way it is possible to position the end member below the tool from the side without hinder of any magnetic attraction force. The end members may be positioned manually or by use of an automatic feeder. The electromagnetic device can be activated when required that is for example during vertical movement above the ground of the pile installation tool or any other use case wherein there is no soil resistance to maintain connection between the end member and the pile installation tool.

In an embodiment, the method comprises arranging the end member at a predetermined position on the ground before coupling the end member to the distal end of the pile installation tool. This provides a simple way of indicating a desired position of a foundation pile.

In an embodiment, the method comprises deactivating the electromagnetic device to release the end member from the pile installation tool after at least partly forming a bore hole. A deactivated electromagnetic device enables to release the end member from the pile installation tool and thus to open a distal end of the tool in order to fill the formed bore hole with a filling material in a controlled manner. The actual deactivation of the electromagnetic device may be done as soon as the end member touches the soil. The soil resistance makes sure that the end member stays connected to the pile installation tool.

In an embodiment of the method, the electromagnetic device comprises a control system, and the method comprises activating the electromagnetic device with a degree depending on a height position of the pile installation tool. This enables to maintain a constant, or minimum, magnetic attraction force between the pile installation tool and the end member over the range of the height position of the pile installation tool with respect to the electromagnetic device. As an option, the degree of activating the electromagnetic device may also depend on the size of the pile installation tool and weight of the end member. Degree of activating the electromagnetic device means degree of resulting magnetic flux and thus magnetic force between the pile installation tool and the end member.

SHORT DESCRIPTION OF DRAWINGS

The present invention will be discussed in more detail below, with reference to the attached drawings, in which FIG. 1 shows a pile installation system according to the invention in side view;

Figure 1:
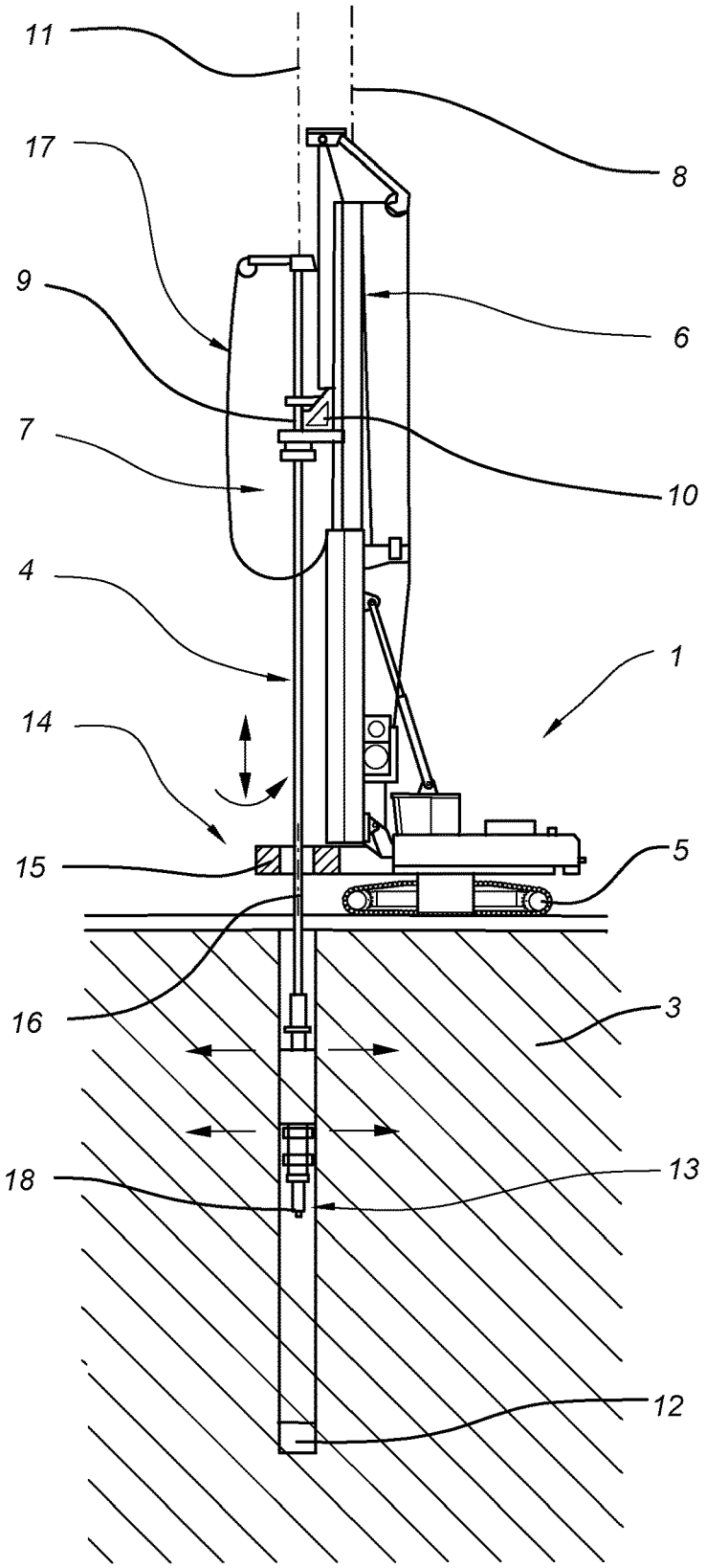
Figure 7:
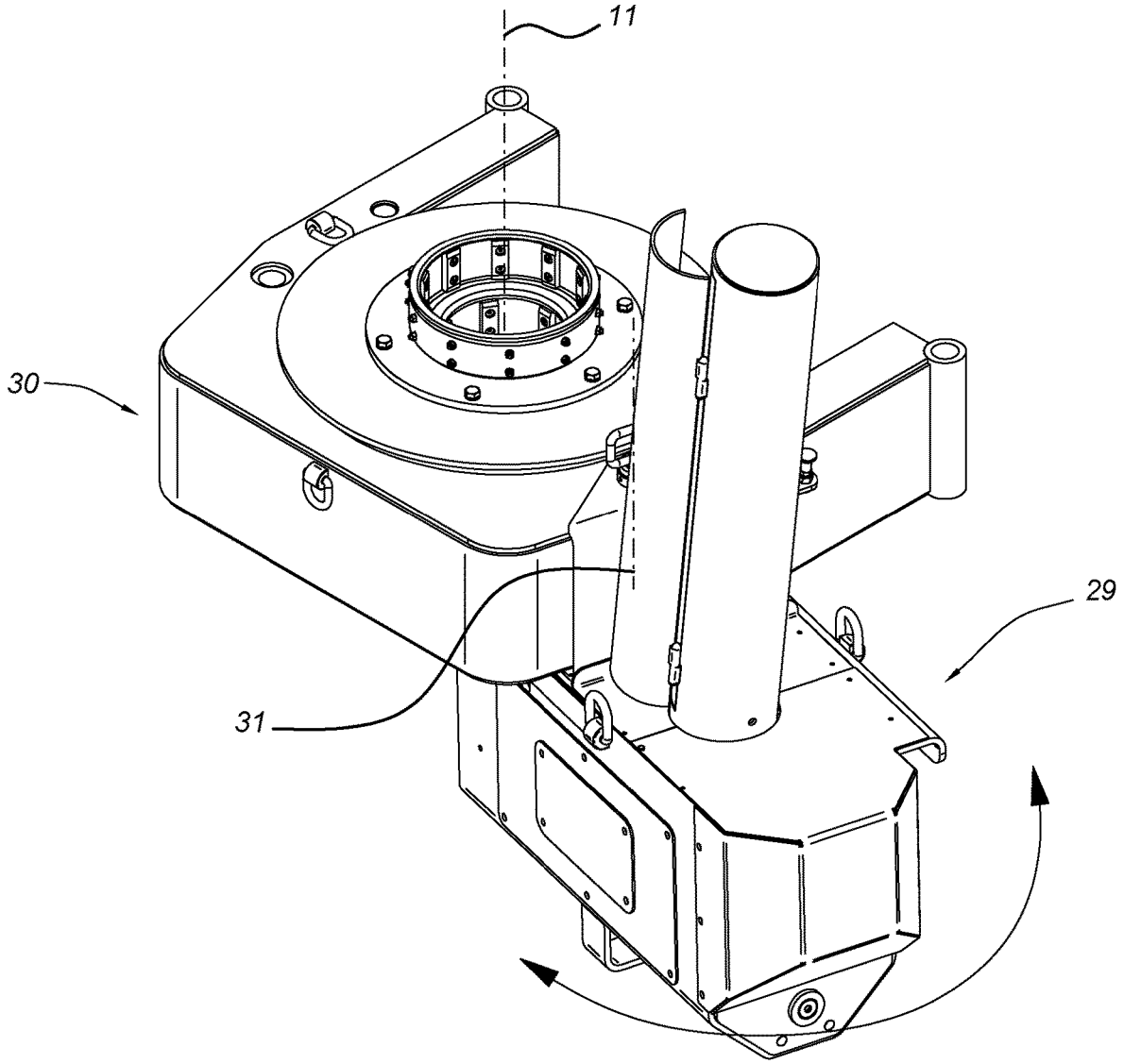
Figure 8A:
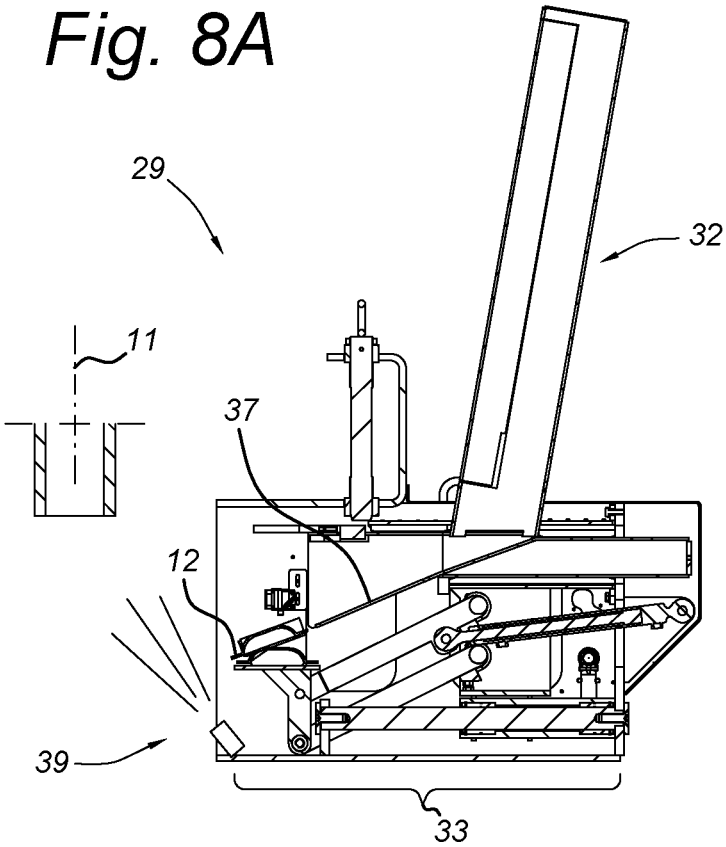
Figure 8B:
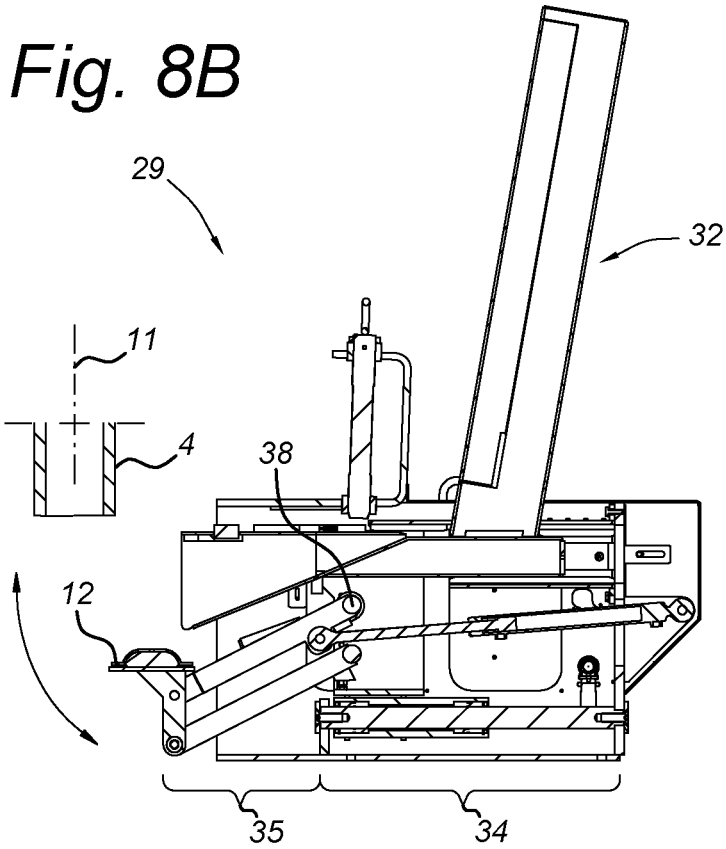
Figure 8C:
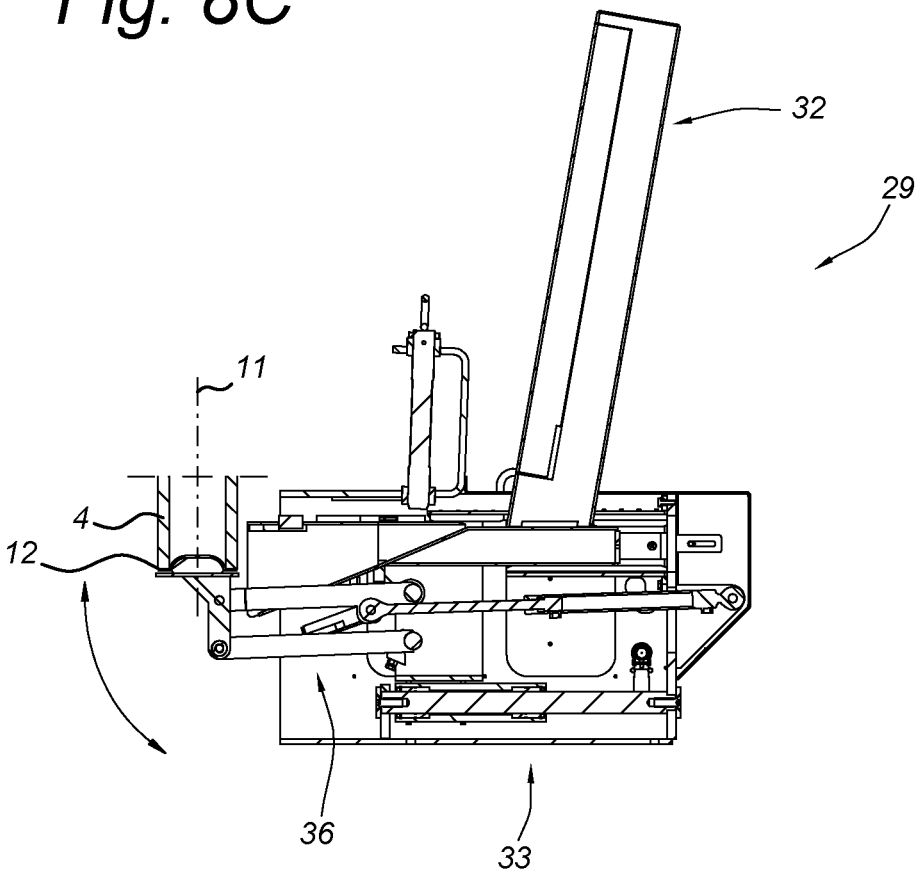
Figure 9:
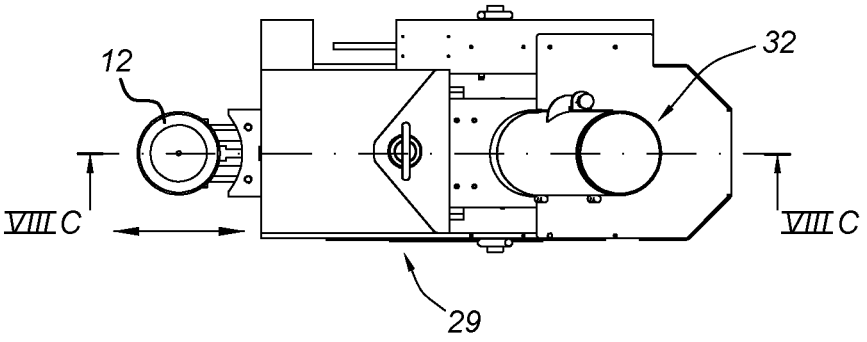

FIGS. 6A-D show subsequent steps of a method for providing a pile in the ground using a pile installation system of FIG. 1;

FIG. 7 shows an embodiment of the pile installation system having an end member feeding system in perspective view;

FIG. 8A-8C show a cross sectional side view of the end member feeding system in different positions; and FIG. 9 is a top view of the end member feeding system in the position shown in FIG. 8C.

DESCRIPTION OF EMBODIMENTS

FIG. 1 shows a pile installation system 1 in side view. The pile installation system 1 provides a foundation pile 2 in the ground 3. The pile installation system 1 comprises a pile installation tool 4. The pile installation tool 4 is elongate for forming a hole 5. The pile installation system 1 comprises a rotary drive apparatus 7 to drive pile installation tool 4, in this case an auger which is an example of a rotary drilling tool. Such a rotatable auger known per se, has an external blade or blades so shaped that upon rotation the blade or blades draws or draw the auger into the ground. The pile installation tool 4 has an axis of rotation 11 which is the longitudinal axis of the pile installation tool 4. The rotary drive apparatus 7, also referred to as a high torque turntable, is mounted to a mast rig 6. The rotary drive apparatus 7 is mounted to the mast rig 6 in a translatable manner such that the mast rig 6 guides the rotary drive apparatus 7 along a longitudinal axis 8 of the mast rig 6. The rotary drive apparatus 7 comprises a rotor 9 coupled with the pile installation tool 4. The rotary drive apparatus 7 comprises a stator 10 coupled with mast rig 6.

Where FIG. 1 shows a rotary drive apparatus 7, it will be clear that the pile installation tool 4 can be driven into the ground by any suitable drive apparatus such as a hydraulic hammer, a vibration hammer, et cetera. The suitable drive apparatus may depend on the type of pile installation tool 4. Thus, the pile installation tool 4 can be moved in a downward direction by drive apparatus in a non-rotational manner. This enables the installation of the pile to be done in a controlled manner depending on the specifics characteristics of the soil. Moreover, the driving apparatus can be provided directly onto the top edge of the pile installation tool 4 or onto a cushioning element (not shown), such as an anvil or the like. The cushioning element can be made of any suitable impact material comprising metallic material, a metal alloy or might also comprise polymeric material.

The pile installation system 1 comprises an end member 12. The end member 12 is configured for coupling to a distal end 13 of the pile installation tool 4. The end member is also referred to as lost shoe, end plate, and forming tip. The end member 12 has for its purpose to assist in forming the bore hole 5 and/or to temporarily close off an open end 18 of the pile installation tool 4.

The pile installation system 1 comprises an electromagnetic device 14. The electromagnetic device 14 is configured for releasable magnetically coupling the end member 12 to the pile installation tool 4. The end member 12 is shown in a released state. The electromagnetic device comprises an annular coil 15. The annular coil 15 extends around the pile installation tool 4. The pile installation tool 4 is moveably arranged with respect to the electromagnetic device 12. Here, the pile installation tool can slide through the annular coil 15, in particular through a centre 16 of the annular coil 15.

It will be clear that the pile installation tool 4 and the end member 12 are at least partially made of a magnetisable material, in this case steel, in order to, in conjunction, form a magnetic circuit that can be activated by the electromagnetic device 14.

The pile installation system 1 comprises a filling system 17. The filling system is configured to introduce filling material, like concrete, into the bore hole 5 after the pile installation tool 4 has been driven into the ground 3. The filling system 17 is known per se and is not described in detail.

Figure 2:
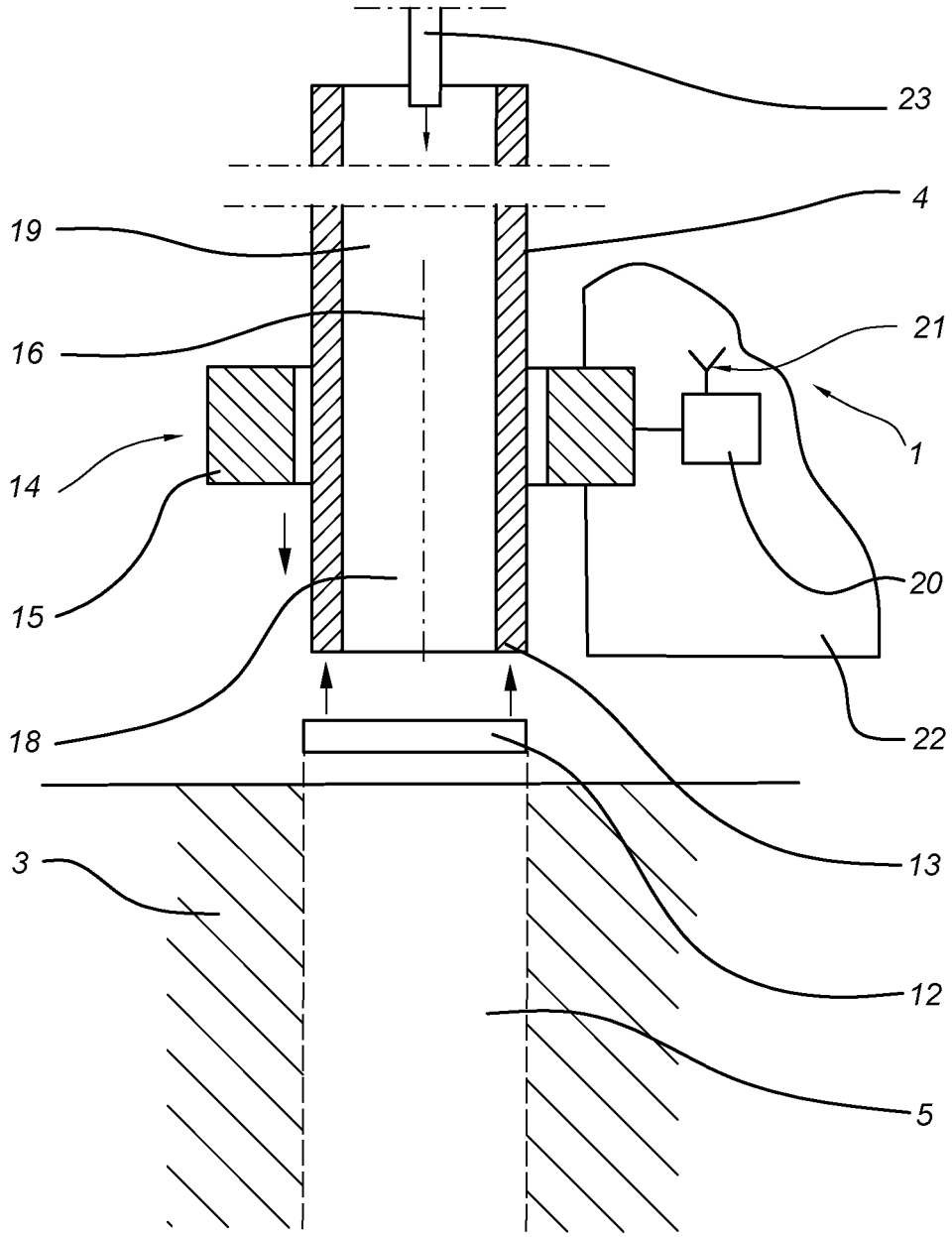
FIG. 2 is a schematic drawing in side view of a detail of the pile installation system of FIG. 1.

FIG. 2 is a schematic drawing in side view of a detail of the pile installation system 1 of FIG. 1. The end member 12 is positioned below the pile installation tool 4 at a position on the ground 3 about or near where a bore hole 5 and thus foundation pile is planned. The electromagnetic device 14 is mounted with a stationary body part 22 of the pile installation system 1. The electromagnetic device 14 provides a controllable magnetic attraction force between the pile installation tool 4 and the end member 12. As long as the electromagnetic device 14 is energized, the end member 12 will stick to the pile installation tool. The pile installation tool 4 can move freely in axial direction in relation to the electromagnetic device 14. The electromagnetic device 14 will be activated when needed. Therefore, undesired attraction of the end member 12 and other steel parts is avoided as much as possible. This way it is possible to position the end member 12 from the side without hinder of any magnetic attraction force. The electromagnetic device 14 comprises a control system 20. Here, the control system 20 is configured to activate the electromagnetic device 14 with a degree depending on a height position of the pile installation tool 4. The control system 14 comprises a connection means 21 like an antenna as shown, to enable remote operation of the electromagnetic device 14. Thus, the electromagnetic device 14 is configured to be remoteably operateable to be activated and/or deactivated.

The end member 12 is shown in a position opposite the distal end 13 of the pile installation tool 4. When the electromagnetic device 14 is activated, the end member 12 is attracted to the pile installation tool 4 and, here, then closes off an open end 18 of the pile installation tool 4. When the bore hole is formed, the internal hollow space 19 of the cylindrical pile installation tool 4 can be filled with a filling material, normally concrete. Here, the filling material is supplied through a filling mouth 23 that is, in this case, arranged at the top of the pile installation tool 4. The filling mouth 23 is part of the filling system 17.

Figure 3:
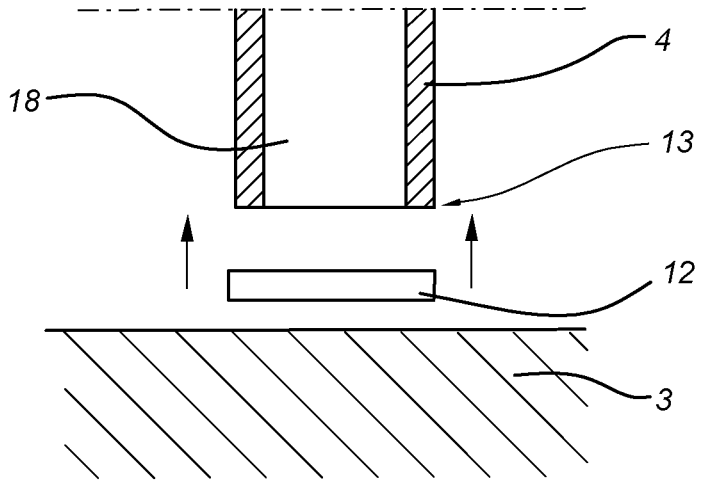
FIGS. 3 and 4 show different type of pile installation tools.
Figure 4:
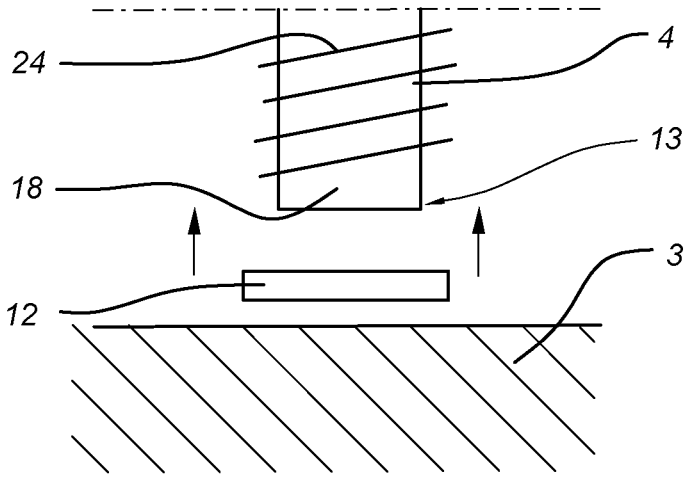

FIGS. 3 and 4 show different type of pile installation tools 4 that can connect to the end member 12. The end member 12 is positioned below the pile installation tool 4 at a position on the ground 3 where a bore hole 5 and thus foundation pile is planned. The end member 12 can be manually or automatically positioned below the pile installation tool 4, when the pile installation tool 4 is still above the soil. When the end member 12 is positioned below the pile installation tool 4 in the right way and/or predetermined position, the electromagnetic device 14 will be activated, so that the end member 12 connects to the pile installation tool 4. The end member 12 is shown in a position opposite the distal end 13 of the pile installation tool 4. The pile installation tool 4 of FIG. 3 is a hollow cylindrical steel pile having an open end 18. The pile installation tool 4 of FIG. 4 is a hollow auger having an open end 18. The auger is provided with a blade 24.

Figure 5:
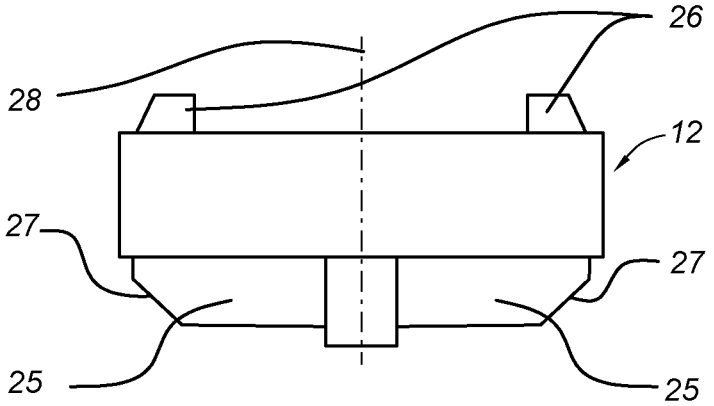
FIG. 5 shows an end member 12 in side view.

FIG. 5 shows an end member 12 in side view. The end member 12 is configured such that loosened soil is directed towards the axis of rotation 28 upon driving the pile installation tool. Therefore, blades 25 can be connected to the end member 12.

The end member 12 comprises a cutting element 27. The cutting element(s) 27 is arranged at a leading side of the end member 12. In this case, the cutting element 27 extends to about an outer circumference of the end member 12. It is however conceivable that the cutting element 27 extends beyond the outer circumference of the end member 12.

The end member 12 is configured to couple to the distal end of the pile installation tool 4. The end member 12 therefore comprises alignment means 26. The alignment means 26 are configured to align the end member 12 with respect to the open distal end 13, 18 of the pile installation tool 4.

The FIGS. 6A-D show subsequent steps of a method for providing a pile 2 in the ground 3 using a pile installation system 1 of FIG. 1. In the FIGS. 6A-D, the shown pile installation tool 4 of FIG. 3 is a hollow cylindrical steel pile. It will be clear that any suitable pile installation tool 4 can be used.

Figure 6A:
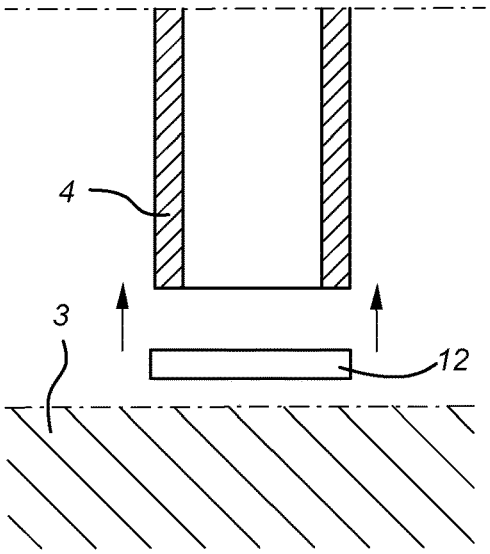

In FIG. 6A the end member 12 has been arranged at a predetermined position on the ground 3 before coupling the end member 12 to the distal end of the pile installation tool 4. Thus, the end member 12 is positioned below the pile installation tool 4 at a position on the ground 3 where a bore hole 5 and thus foundation pile 2 is planned.

Figure 6B:
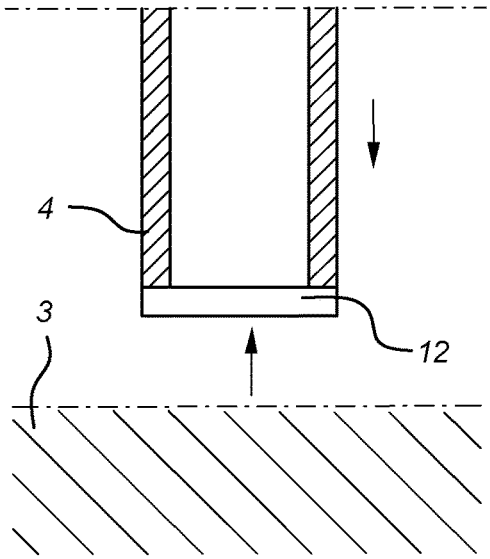

In FIG. 6B the electromagnetic device 14 of FIGS. 1 and 2 (not shown here) has been activated and the end member 12 is magnetically coupled to the distal end of the pile installation tool 4.

Figure 6C:
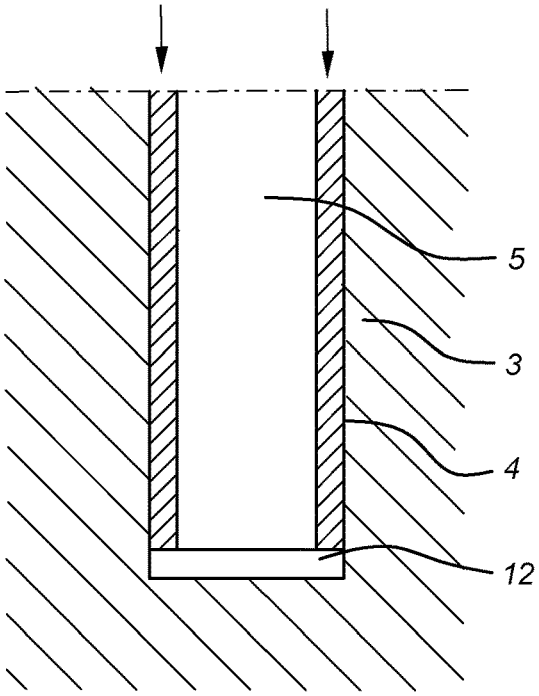

In FIG. 6C the pile installation tool 4 is introduced into the ground 3. The formed bore hole is ready to receive a filing material.

Figure 6D:
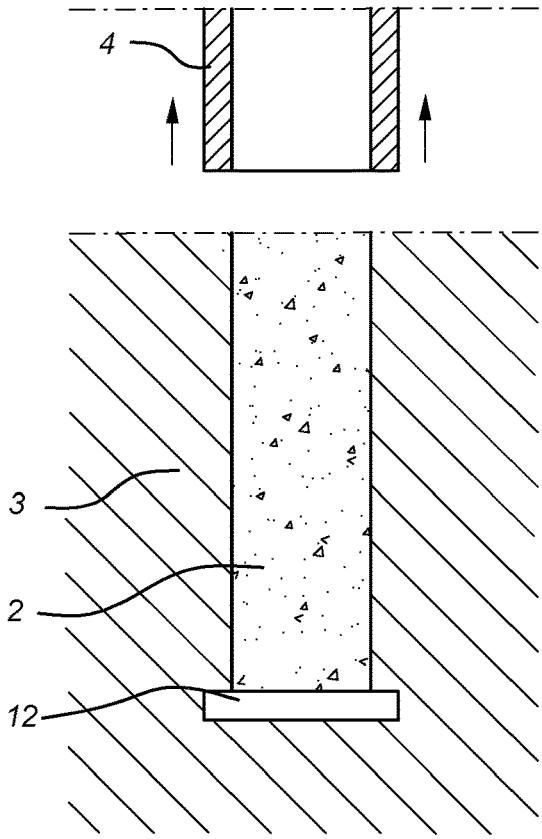

In FIG. 6D the electromagnetic device has been deactivated and the end member 12 is released from the pile installation tool 4. The pile 2 has been formed and the pile installation tool 4 is removed out of the ground 3. The deactivation of the electromagnetic device is a condition to allow the end member 12 to release from the pile installation tool 4. The actual deactivation of the electromagnetic device may be done as soon as the end member touches the soil. The soil resistance makes sure that the end member stays connected to the pile installation tool.

FIG. 7 shows an embodiment of the pile installation system 1 having an end member feeding system 29 in perspective view. The end member feeding system 29 is connected to the pile installation tool. In this case, the end member feeding system 29 is releasably connected to the pile installation tool. Here, the end member feeding system 29 is coupled to the pile installation tool through a lower guide frame 30 that guides the pile installation tool 4 (not shown here) in a slideable manner. The lower guide frame 30 may contain the annular coil 15 of FIGS. 1 and 2, however the annular coil 15 is not shown here. The end member feeding system 29 is arranged radially offset with respect to the longitudinal axis 11 of the pile installation tool 4. The end member feeding system 29 is swivelably coupled to the pile installation tool 4. In this case, the end member feeding system is swivelably around a swivel axis 31 that extends in parallel with respect to the longitudinal axis 11 of the pile installation tool 4.

FIG. 8A-8C show a cross sectional side view of the end member feeding system 29 in different positions. Different positions is to say that an end member that is fed to the pile installation tool 4 is shown in different consecutive positions. The end member feeding system 29 positions the end member 12 below the pile installation tool 4 from the side. The end member feeding system 29 comprises a storage 32. The storage 32 is configured for storing a number of end members 12. Here, the storage 32 contains a stack of a number of end members 12. In this case, the storage 32 extends in parallel to the pile installation tool 4. The storage 32 can be arranged in a slanted way with respect to the vertical pile installation tool 4, as shown.

Referring to FIG. 8A, the end member feeding system 29 comprises a handling system 33. The handling system 33 is configured for moving an end member 12 from the storage 32 to the pile installation tool 4. Here, the end member 12 moves over a slide 37 from the storage 32 to the handling system 33 once the end member 12 is released from the storage 32.

The end member feeding system 29 comprises a cleaning system 39. The cleaning system 39 jets water for cleaning the distal end of the pile installation tool 4.

Referring to FIG. 8B, the handling system 33 comprises a first handling unit 34. The first handling unit 34 is configured for moving an end member in a radial direction with respect to the pile installation tool 4. Therefore, the first handling unit 34 comprises any suitable linear actuator. In FIG. 8B the first handling unit is shown in the extended position. In FIG. 8A the first handling unit 34 is shown in the retracted position. The handling system 33 comprises a second handling unit 35. The second handling unit 35 is configured for moving an end member 12 in an axial direction with respect to the pile installation tool 4. The first 34 and second 35 handling unit are mechanically series coupled. The second handling unit 35 comprises rotary action around a rotation axis 38. Therefore, the second handling unit 35 comprises any suitable actuator. It is of course conceivable that the second handling unit 35 effects movement of the end member 12 in an axial direction only with respect to the pile installation tool 4. Here, the second handling unit 35 of the handling system 33 comprises a parallel guide system 36. In FIG. 8B the second handling unit 35 is shown in the axial downward position.

In FIG. 8C the second handling unit 35 is shown in the axial upward position. The end member 12 contacts the distal end of the pile installation tool 4.

FIG. 9 is a top view of the end member feeding system 29 wherein the handling system 33 is shown in the position of FIG. 8C, wherein the end member 12 is positioned below the pile installation tool 4 before the pile installation tool 4 is driven into the ground.

The present invention has been described above with reference to a number of exemplary embodiments as shown in the drawings. Modifications and alternative implementations of some parts or elements are possible, and are included in the scope of protection as defined in the appended claims.

The invention claimed is:

1. A pile installation system comprising:

an elongate pile installation tool for forming a bore hole and having a distal end, an end member for coupling to the distal end of the pile installation tool, an electromagnetic device for releasable magnetic coupling of the end member to the pile installation tool, wherein the electromagnetic device comprises an annular coil that wraps fully around an outer circumference of the elongate pile installation tool, and wherein the pile installation tool is able to move through the electromagnetic device.

2. The pile installation system according to claim 1, wherein the electromagnetic device is configured to be remoteably operateable to be activated and/or deactivated.

3. The pile installation system according to claim 1, wherein an outer diameter of the end member is the same as an outer diameter of the pile installation tool.

4. The pile installation system according to claim 1, comprising a filling system for introducing filling material into the bore hole after the pile installation tool has been driven into the ground.

5. The pile installation system according to claim 4, wherein the distal end of the pile installation tool is open and in fluid communication with the filling system and the end member is configured to close at least partially the open end.

6. The pile installation system according to claim 1, comprising a drive apparatus to drive the pile installation tool into the ground.

7. The pile installation system of claim 6, wherein the pile installation tool is a rotary drilling tool having an axis of rotation, and the drive apparatus comprises a rotary drive to drive the rotary drilling tool into the ground.

8. The pile installation system of claim 7, wherein the rotary drilling tool is a rotatable auger having an external blade or blades so shaped that upon rotation the blade or blades draws or draw the auger into the ground.

9. The pile installation system of claim 7, wherein the rotary drive apparatus comprises a rotor coupled with the pile installation tool and a stator coupled with the electromagnetic device, wherein the pile installation tool is slideably arranged with respect to the electromagnetic device to slide through the annular coil.

10. The pile installation system of claim 6, wherein the pile installation tool comprises a hollow tubular element and the drive apparatus uses a hammering or vibration to drive the hollow tubular element into the ground.

11. The pile installation system according to claim 1, wherein the end member is configured such that loosened soil is directed towards the axis of rotation upon driving the drilling tool.

12. The pile installation system according to claim 1, wherein the end member comprises a cutting element at a leading side of the end member.

13. The pile installation system of claim 12, wherein the cutting element extends beyond an outer circumference of the end member.

14. The pile installation system according to claim 1, comprising alignment means to align the end member with respect to the open distal end of the pile installation tool.

15. The pile installation system according to claim 1, wherein the pile installation tool and the end member are at least partially made of a magnetisable material in order to, in conjunction, form a magnetic circuit.

16. The pile installation system according to claim 1, wherein the electromagnetic device comprises a control unit to adjust a magnetic force between the pile installation tool and the end member.

17. The pile installation system according to claim 1, comprising an end member feeding system for supplying the end member to the pile installation tool.

18. The pile installation system according to claim 17, wherein the end member feeding system is coupled to the pile installation tool and arranged radially offset with respect to the longitudinal axis of the pile installation tool.

19. The pile installation system according to claim 18, wherein the end member feeding system is swivelably coupled to the pile installation tool.

20. The pile installation system according to claim 1, and further comprising a handling system comprising a first handling unit for moving an end member in a radial direction with respect to the pile installation tool, and a second handling unit for moving an end member in an axial direction with respect to the pile installation tool.

21. A method comprising:

providing a pile installation tool having a distal end, and an end member for coupling to the distal end of the pile installation tool, and activating an electromagnetic device comprising an annular coil wrapping fully around an outer circumference of the elongate pile installation tool, wherein the activating causes the end member to magnetically couple to the distal end of the pile installation tool, wherein the pile installation tool is able to move through the electromagnetic device.

22. The method according to claim 21, and further comprising: at least partly forming a bore hole with the end member coupled to the pile installation tool; an deactivating the electromagnetic device to release the end member from the pile installation tool after at least partly forming a bore hole.

23. The method according to claim 21, wherein the electromagnetic device comprises a control system, and the method comprises activating the electromagnetic device based on a height position of the pile installation tool.

* * * * *